United States Patent [19]

Watanabe

[11] Patent Number: 4,577,849

[45] Date of Patent: Mar. 25, 1986

[54] MULTIPLE SOURCE PAPER CONVEYOR SYSTEM

[75] Inventor: Junji Watanabe, Yokohama, Japan

[73] Assignee: Tokyo Shibaura Denki Kabushiki Kaisha, Kawasaki, Japan

[21] Appl. No.: 494,888

[22] Filed: May 16, 1983

[30] Foreign Application Priority Data

May 31, 1982 [JP] Japan ..... 57-91173

[51] Int. Cl.[4] ..... B65H 3/06; B65H 3/44

[52] U.S. Cl. ..... 271/9; 271/10; 271/21; 271/116

[58] Field of Search ..... 271/4, 6, 9, 10, 16, 271/17, 21, 22, 109, 114, 116; 400/605

[56] References Cited

U.S. PATENT DOCUMENTS

| | | | |
|---|---|---|---|
| 3,908,195 | 9/1975 | Leenhouts | 318/696 |
| 4,084,805 | 4/1978 | Simpson | 271/9 |
| 4,248,415 | 2/1981 | Steinhilber | 271/9 |

FOREIGN PATENT DOCUMENTS 2857074 8/1980 Fed. Rep. of Germany .

*Primary Examiner*—Bruce H. Stoner, Jr.
*Assistant Examiner*—James E. Barlow
*Attorney, Agent, or Firm*—Cushman, Darby & Cushman

[57] ABSTRACT

In a paper conveyor system which conveys two types of paper, there are provided first and second feeding rollers which contact the top papers of two types of paper, respectively. First and second clutches, which are attached to the first and second feeding rollers, respectively, transmit rotation in one direction to the first and second feeding rollers, and prevent rotation in the opposite direction from being transmitted to the first and second feeding rollers. A first transmission mechanism is arranged between a reversible motor and the first clutch to transmit the rotation of the motor to the first clutch so that the first clutch rotates in the same direction as the rotating direction of the motor. A second transmission mechanism is arranged between the motor and the second clutch to transmit the rotation of the motor to the second clutch so that the second clutch rotates in the opposite direction to that of the motor.

12 Claims, 15 Drawing Figures

MULTIPLE SOURCE PAPER CONVEYOR SYSTEM

BACKGROUND OF THE INVENTION

This invention relates to a paper conveyor system for conveying at least two types of paper.

Paper conveyer systems include, for example, a paper feeding device used in an electronic copying apparatus. In an electronic copying apparatus, a first container unit containing first paper and a second container unit containing second paper are removably attached to the housing of the apparatus. A manual feed guide is also attached to the apparatus housing. The paper feeding device is used for selectively feeding the first or second paper from the first or second paper container unit, comprising a delivery member to deliver paper fed through first and second feeding members and the manual feed guide into the apparatus housing. The feeding device further comprises an orientation/feeding member which delivers the paper fed thereto after first orienting it. The orientation/feeding member serves to feed the paper in synchronism with the copying processes of the copying apparatus.

In the prior art paper feeding device, separate drive sources are used to drive the delivery member and the orientation/feeding member. Accordingly, the feeding device is large-sized and complicated.

SUMMARY OF THE INVENTION

This invention is contrived in consideration of these circumstances, and is intended to provide a paper conveyor system simple in construction and conductive to miniaturization.

DETAILED DESCRIPTION OF THE PREFERRED EMBODIMENTS

Referring now to the accompanying drawings of FIGS. 1 to 8, there will be described a paper conveyor system according to a first embodiment of this invention which is applied to an electronic copying apparatus.

Figure 2:
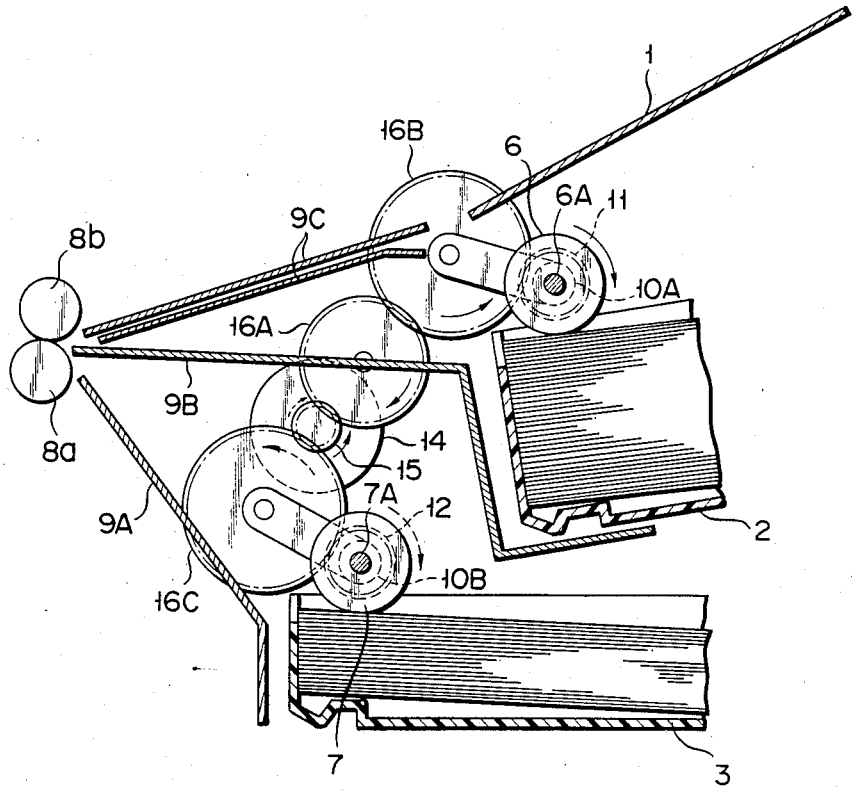
FIG. 2 is a side view showing a drive system for first and second delivery members used in the paper feeding device.

In an electronic copying apparatus provided with a paper feeding device as the paper conveyor system, a manual feed guide 1 for manual paper feeding, a first paper container unit, e.g., a first paper cassette 2, containing a first pile of paper Pa, and a second paper container unit, e.g., a second paper cassette 3, containing a second pile of paper Pb are removably attached to a copying apparatus housing 4. First feeding members for feeding paper, e.g., a pair of manual feed rollers or a feeding roller and pinch roller, respectively 5*a* and 5*b* for delivering the manually fed paper, are arranged at the back of the manual feed guide 1 so as to be in contact with each other. Over the first paper cassette 2 lie first delivery members, e.g., first delivery or feeding rollers 6, for delivering by frictional engagement the uppermost sheet out of the first pile of paper Pa. The first delivery rollers 6 are located so as to be in rolling contact with the uppermost sheet. A shaft 6A is fixed coaxially to the first delivery rollers 6 so that the delivery rollers 6 rotate as the shaft 6A rotates. Over the second paper cassette 3 lie second delivery members, e.g., second delivery or feeding rollers 7, for delivering by frictional engagement the uppermost sheet out of the second pile of paper Pb. The second delivery rollers 7 are located so as to be in rolling contact with the uppermost sheet. A shaft 7A is fixed coaxially to the second delivery rollers 7 so that the delivery rollers 7 rotate as the shaft 7A rotates. A pair of resisting rollers or a feeding roller and pinch roller, respectively 8*a* and 8*b* as second feeding members are arranged in contact with each other to orient and feed paper delivered from the manual feed rollers 5*a* and 5*b* and the first or second delivery rollers 6 or 7. As shown in FIG. 2, paper guides 9A, 9B and 9C are provided individually between the rollers 7, 6 and 5*a* and the resisting rollers 8*a* and 8*b*.

Figure 1:
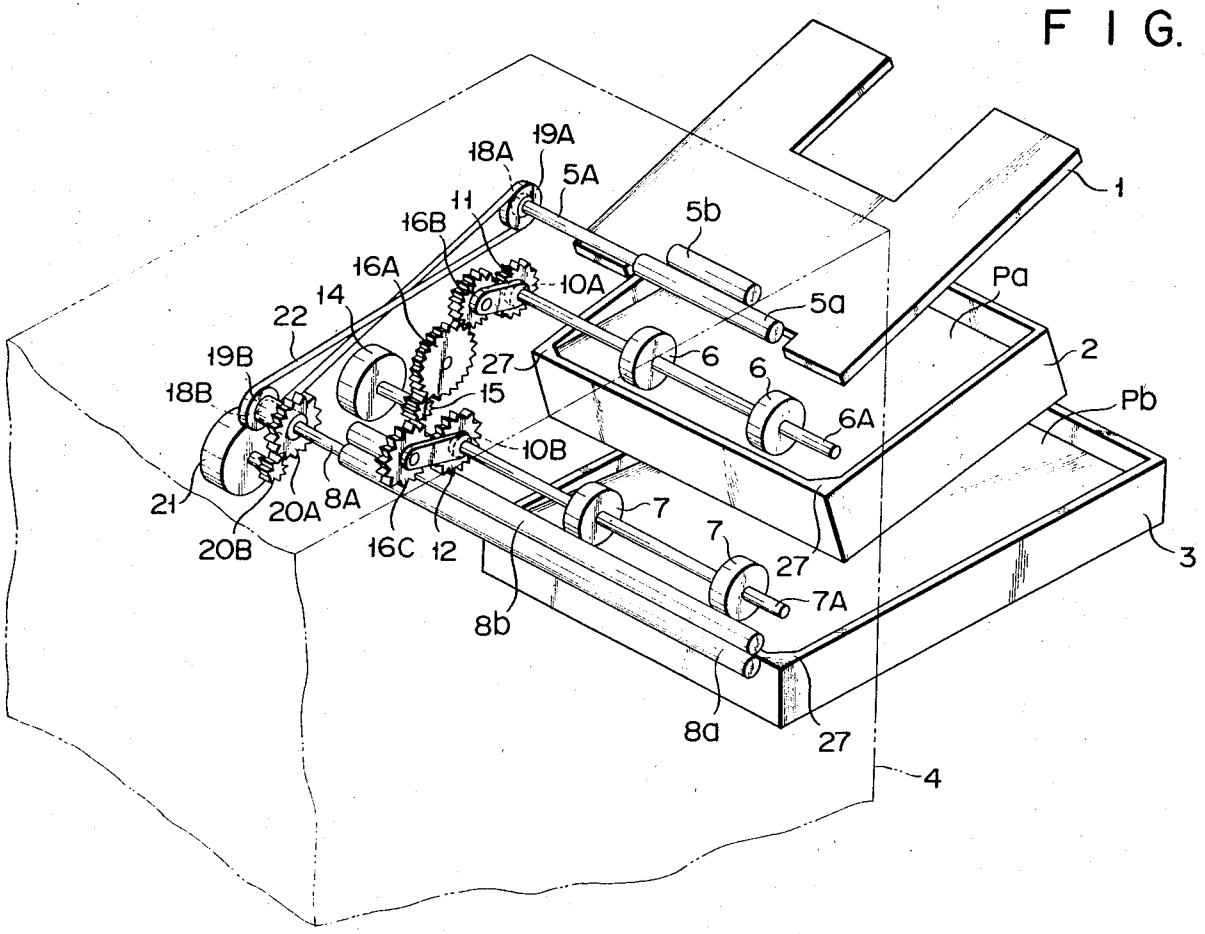
FIG. 1 is a schematic perspective view of a paper conveyor system according to a first embodiment of this invention applied to a paper feeding device.

Referring now to FIGS. 1 and 2, there will be described a first drive system for the first and second delivery rollers 6 and 7. A first driven gear 11 is attached to one end portion of the shaft 6A by means of a first one-way clutch 10A. The first one-way clutch 10A serves to transmit only the clockwise rotation of the first driven gear 11 to the shaft 6A. A second driven gear 12 is attached to one end portion of the shaft 7A by means of a second one-way clutch 10B. The second one-way clutch 10B serves to transmit only the clockwise rotation of the second driven gear 12 to the shaft 7A. A first drive source, e.g., a first reversible stepping motor 14, is disposed in the apparatus housing 4. A pinion gear 15 is mounted on the driving shaft of the first stepping motor 14.

Two idle gears 16A and 16B are arranged in mesh with each other between the pinion gear 15 and the first driven gear 11. Also, an idle gear 16C is disposed between the pinion gear 15 and the second driven gear 12 so as to mesh these two gears. If the pinion gear 15 is rotated counterclockwise, as shown in FIG. 2, only the first delivery rollers 6 rotate clockwise through the medium of the first one-way clutch 10A and the idle gears 16A and 16B. If the pinion gear 15 is rotated clockwise, only the second delivery rollers 7 rotate clockwise through the medium of the second one-way clutch 10B and the idle gear 16C.

Figure 3:
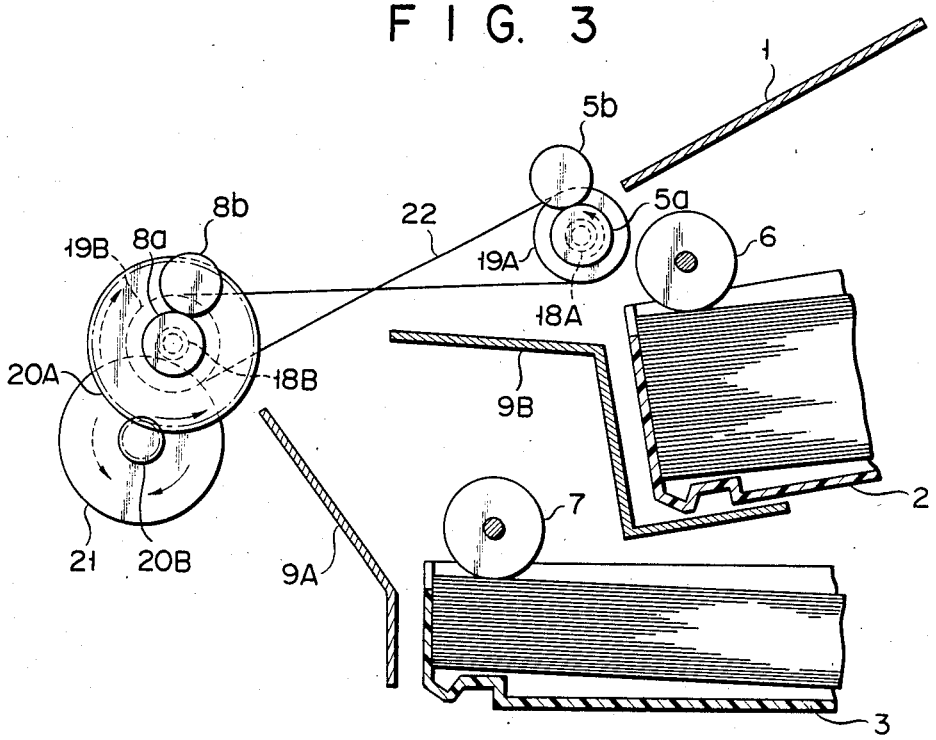
FIG. 3 is a side view showing a drive system for first and second feeding members used in the paper feeding device.

Referring now to FIGS. 1 and 3, there will be described a second drive system for the resisting rollers 8*a* and 8*b* and the manual feed rollers 5*a* and 5*b*. A shaft 5A is attached coaxially to the lower manual feed roller 5*a*. A driven pulley 19A is attached to one end portion of the shaft 5A by means of a third one-way clutch 18A. The third one-way clutch 18A serves to transmit only the counterclockwise rotation of the driven pulley 19A to the shaft 5A. A shaft 8A is attached coaxially to the lower resisting roller 8*a*. A driving pulley 19B and a driven gear 20A are fixed to one end portion of the shaft 8A by means of a fourth one-way clutch 18B. The driving pulley 19B is so designed as to rotate together with the driven gear 20A. The fourth one-way clutch 18B serves to transmit only the counterclockwise rotation of the driven gear 20A to the shaft 8A.

A belt 22 is stretched crosswise between the driven pulley 19A and the driving pulley 19B. The driven gear 20A is in mesh with a pinion gear 20B which is mounted on the driving shaft of a second drive source, e.g., a second reversible stepping motor 21. If the pinion gear 20B is rotated clockwise, as shown in FIG. 3, only the lower resisting roller 8*a* is driven counterclockwise by the agency of the one-way clutches 18A and 18B. If the pinion gear 20B is rotated counterclockwise, on the other hand, only the lower manual feed roller 5*a* is driven counterclockwise.

Figure 4:
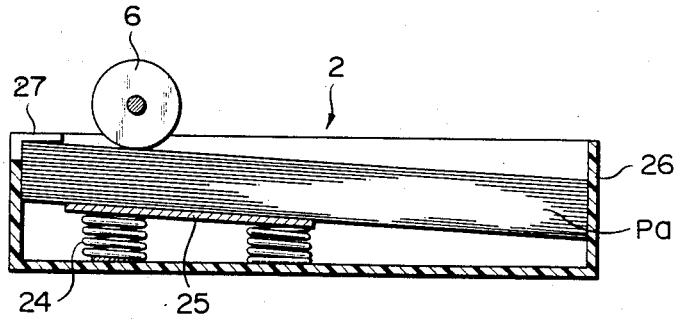
FIG. 4 is a cross-sectional view showing a first paper container unit.

Now the construction of the first and second paper container units or paper cassettes 2 and 3 will be described in detail. FIG. 4 shows a cross section of only the first paper cassette 2, since the two paper cassettes 2 and 3 have substantially the same construction. The first paper cassette 2 comprises a cassette housing 26 and a backup plate 25 urged upward by a plurality of springs 24 at the bottom portion of the cassette housing 26. Thus, the uppermost sheet abuts against the first delivery rollers 6 when the first paper cassette 2 is attached to the apparatus housing 4 with the first pile of paper Pa on the backup plate 25. Single paper members, e.g., separating claws 27 (see FIG. 5A for details), are formed individually at both corner portions of the forward end portion (on the left-hand side of FIG. 4) of the cassette housing 26 as viewed along the direction of paper delivery. The separating claws 27 hold both corner portions of each sheet of paper Pa on the front end side thereof (left-hand side of FIG. 4) to single out the sheet. Thus, the sheets of paper Pa in the cassette housing 26 are picked up and delivered one by one.

Figure 5A:
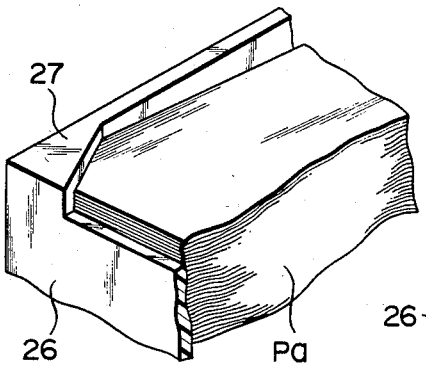
FIG. 5A is a perspective view showing a separating catch.
Figure 5B:
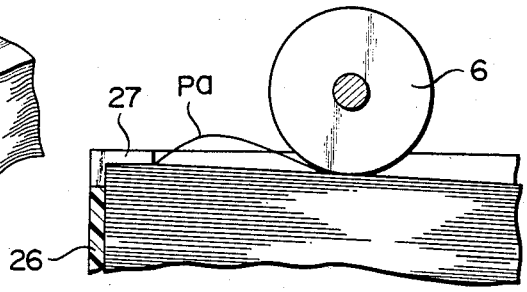
FIGS. 5B and 5C are side views showing the way a sheet of paper is picked up.
Figure 5C:
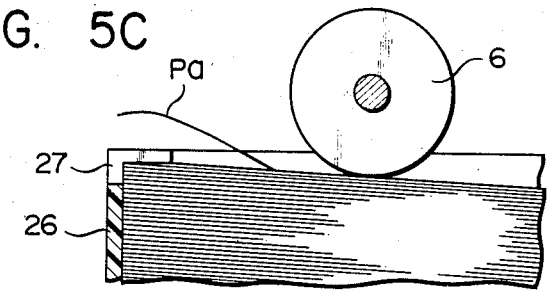
Figure 6:
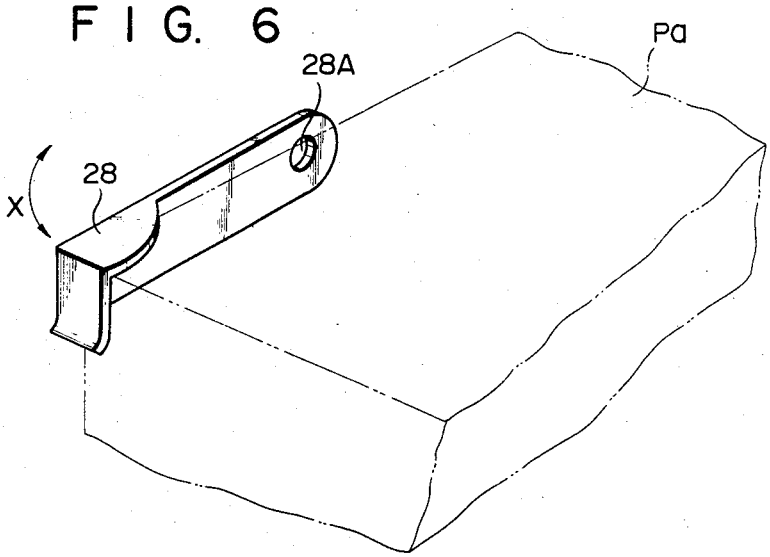
FIG. 6 is a perspective view showing an alternative separating catch.

There will now be described the processes of paper delivery by the use of the separating claws 27. When the first delivery rollers 6 are rotated, the sheet Pa is first restrained from moving forward by the separating claws 27 to be distorted, as shown in FIG. 5B. When the sheet Pa is distorted to a certain degree, it is disengaged from the separating claws 27 and transferred forward, as shown in FIG. 5C. The conveying force of the first delivery rollers 6 which acts on the sheet Pa before the sheet Pa is disengaged from the separating claws 27 is greater than the force used thereafter. This is so because the distortion of the sheet Pa requires much energy. In a drive control system for the first stepping motor 14 to drive the first and second delivery rollers 6 and 7, the first stepping motor 1 is controlled so that relatively large torque may be obtained before the sheet Pa is disengaged from the separating claws 27. The separating claws 27 is not limited to the type shown in FIG. 5A which is fixed to the cassette housing 26. For example, a movable claws 28 may be used, as shown in FIG. 6, which can rock by its own weight around its rear end portion 28 in the direction of arrow X.

The drive control system for controlling the drive of the first and second stepping motors 14 and 21 will now be described. In general, a stepping motor is so designed that a rotor is rotated step by step with a set step angle of the stepping motor by selectively passing DC current through the windings of the stator in several phases. A drive control system (not shown) to control the drive of such a stepping motor may comprise a driver circuit for selectively passing DC current through the windings of the stator of the stepping motor, that is, for excitation phase switching, a DC power source for supplying the driver circuit with voltage to be applied to the stepping motor, and an oscillator for supplying the driver circuit with pulses as references of the excitation phase switching. The first and second stepping motors 14 and 21 are provided with their respective drive control systems. The driver circuit stores a plurality of excitation phase switching times required for rotating the stepping motor the desired angular distances. This driver circuit counts clock pulses supplied from the oscillator. When the pulses for a specified excitation phase switching time are counted up, the driver circuit delivers an excitation phase switching pulse to change the excitation phase. Thus, the excitation phase is changed in succession from the start to stop of the stepping motor so that the stepping motor may be driven for the desired angular distance. The rotating direction of the rotor of the stepping motor can be changed by varying the excitation phase switching direction. Also, the rotating speed and output torque may be controlled by changing the excitation phase switching time.

Figure 7:
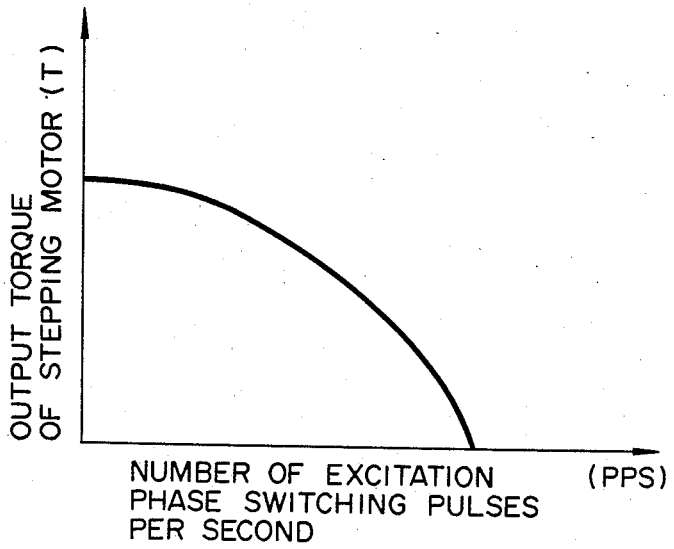
FIG. 7 is a diagram showing a torque-speed characteristic curve of a stepping motor.
Figure 8:
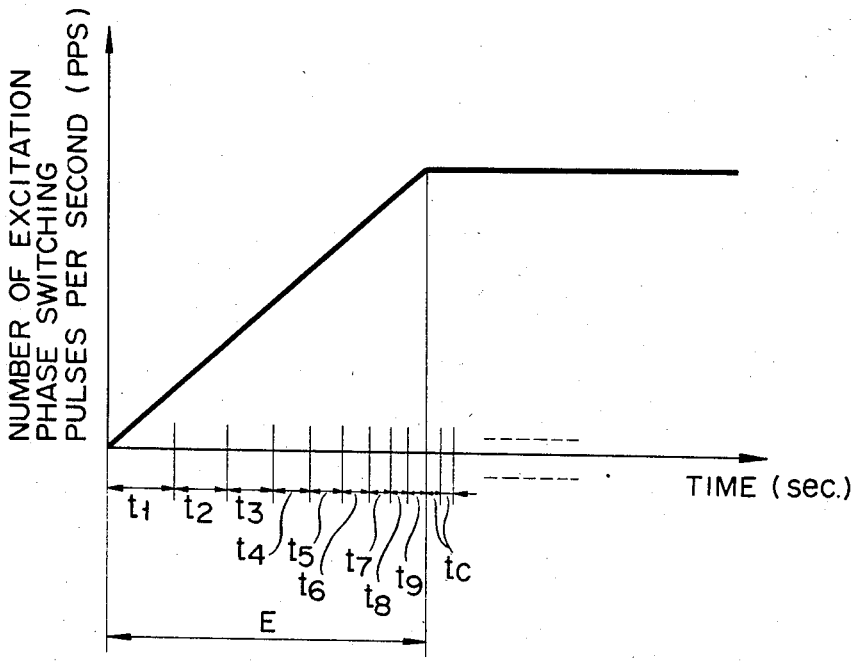
FIG. 8 is a diagram illustrating the conditions of accelerated operation of the stepping motor.

In particular, the drive control system for the first stepping motor 14 controls the drive of the first stepping motor 14 so that relatively great torque may be obtained before the sheet of paper Pa or Pb is disengaged from the separating claws 27. FIG. 7 shows a torque-speed characteristic curve of the stepping motor. In FIG. 7, the axis of ordinate T represents the output torque of the rotor of the stepping motor, while the axis of abscissa PPS indicates the number of excitation phase switching pulses per second equivalent to the rotor speed. As seen from FIG. 7, the longer the excitation phase switching pulse interval (i.e., the lower the rotor speed), the greater the torque obtained. In order to efficiently achieve work which requires great torque, therefore, it is desired that the stepping motor be driven within a relatively wide range of torque. In driving the stepping motor, load generally requires starting torque, so that the stepping motor is controlled at the desired steady-state rotation after gradually accelerating the rotation of the rotor. Accordingly, at least the time interval which elapses from the instant that the stepping motor is started until the sheet Pa or Pb is disengaged from the separating claws 27 is reserved as a rotor acceleration period E which is to precede the steady-state rotation. Thus, great torque may be efficiently applied to the sheet Pa or Pb when it is disengaged from the separating claws 27. To attain this, it is necessary only that the several excitation phase switching times ($t_1$, $t_2$, ..., $t_c$) be set in the driver circuit so that they vary in a gradually reducing manner ($t_1 > t_2 > t_3 > t_4 > t_5 > t_6 > t_7 > t_8 > t_9$) during the acceleration period E and are constant ($t_c$) after the period E, as shown in FIG. 8.

The stepping motor undergoes accelerated operation in the region (self-start region) where responses may be given to the start, stop and reversal of the stepping motor in synchronism with signals based on the excitation phase switching pulses, that is, in the region enveloped by the coordinate axes and the torque-speed characteristic curve of FIG. 7. Under these operating conditions, quite stable synchronous paper feeding can be performed even though the load on the motor varies due to variations in the firmness or shape of paper.

The operation of the paper feeding device will now be described in detail.

In feeding paper from the first paper cassette 2, the first stepping motor 14 is rotated in the counterclockwise direction of FIG. 2. The rotatory force of the first stepping motor 14 is transmitted as a clockwise rotatory force to the first driven gear 11 by means of the idle gears 16A and 16B. Therefore, the rotatory force is transmitted to the first delivery rollers 6 by the first one-way clutch 10A, so that the first delivery rollers 6 are rotated in the clockwise direction of FIG. 2. The counterclockwise rotatory force of the first stepping motor 14 is also transmitted to the second driven gear 12 as a counterclockwise rotatory force. However, this rotation is prevented by the second one-way clutch 10B from being transmitted to the second delivery rollers 7. Thus, the second delivery rollers 7 are not rotated.

In feeding paper from the second paper cassette 3, on the other hand, the first stepping motor 14 is rotated in the clockwise direction of FIG. 2. The rotatory force of the first stepping motor 14 is transmitted as a clockwise rotation to the second driven gear 12 by means of the idle gear 16C. Therefore, the rotatory force is transmitted to the second delivery rollers 7 by the second one-way clutch 10B, so that the second delivery rollers 7 are rotated in the clockwise direction of FIG. 2. The clockwise rotatory force of the first stepping motor 14 is also transmitted to the first driven gear 11 as a counterclockwise rotatory force. However, this rotatory force is prevented by the first one-way clutch 10A from being transmitted to the first delivery roller 6. Thus, the first delivery rollers 6 are not rotated.

In this manner, the first or second paper cassette 2 or 3 may be designated as the paper source by selecting the rotating direction of the first stepping motor 14. In the drive of the first stepping motor 14, the motor 14 is gradually accelerated at least during the time interval which elapses from the instant that the motor 14 is started until the sheet Pa or Pb is disengaged from the separating claws 27, and is then put into steady-state rotation. Accordingly, great torque may be efficiently applied to the sheet Pa or Pb when it is disengaged from the separating catches 27. Thus, the paper feeding may be executed with stability and high efficiency.

In delivering the paper manually fed through the manual feed guide 1, the second step motor 21 is rotated in the counterclockwise direction of FIG. 3. The rotatory force of the second stepping motor 21 is transmitted as a counterclockwise rotatory force to the driven pulley 19A by means of the driving pulley the belt 22. Therefore, the rotatory force is transmitted to the lower manual feed roller **5*a* by the third one-way clutch 18A, so that the manual feed roller 5*a* is rotated in the counterclockwise direction of FIG. 3. The counterclockwise rotatory force of the second stepping motor 21 is also transmitted to the driven gear 20A as a clockwise rotatory force. However, this rotatory force is prevented by the fourth one-way clutch 18B from being transmitted to the lower resisting roller 8*a*. Thus, the lower resisting roller 8*a*** is not rotated.

In delivering the paper fed from the first or second paper cassette 2 or 3 through the manual feed guide 1 with controlled timing by means of the resisting rollers **8*a* and 8*b*, the second stepping motor 21 is rotated in the clockwise direction of FIG. 3. The rotatory force of the second stepping motor 21 is transmitted as a counterclockwise rotatory force to the driven gear 20A. Therefore, the rotatory force is transmitted to the lower resisting roller 8*a* by the fourth one-way clutch 18B, so that the lower resisting roller 8*a* is rotated in the counterclockwise direction of FIG. 3. The clockwise rotatory force of the second stepping motor 21 is also transmitted to the driven pulley 19A as a clockwise rotatory force. However, this rotatory force is prevented by the third one-way clutch 18A from being transmitted to the lower manual feed roller 5*a*. Accordingly, the lower manual feed roller 5*a*** is not rotated.

Thus, the resisting roller **8*a* or the manual feed roller 5*a* may be rotated in an alternative manner by selecting the rotating direction of the second stepping motor 21**.

This invention is not limited to the construction of the first embodiment described above, and various changes and modifications may be effected therein by one skilled in the art without departing from the scope or spirit of the invention. Alternative embodiments will now be described in detail. In the description to follow, like reference numerals are used to designate like portions as described in connection with the first embodiment.

Figure 9:
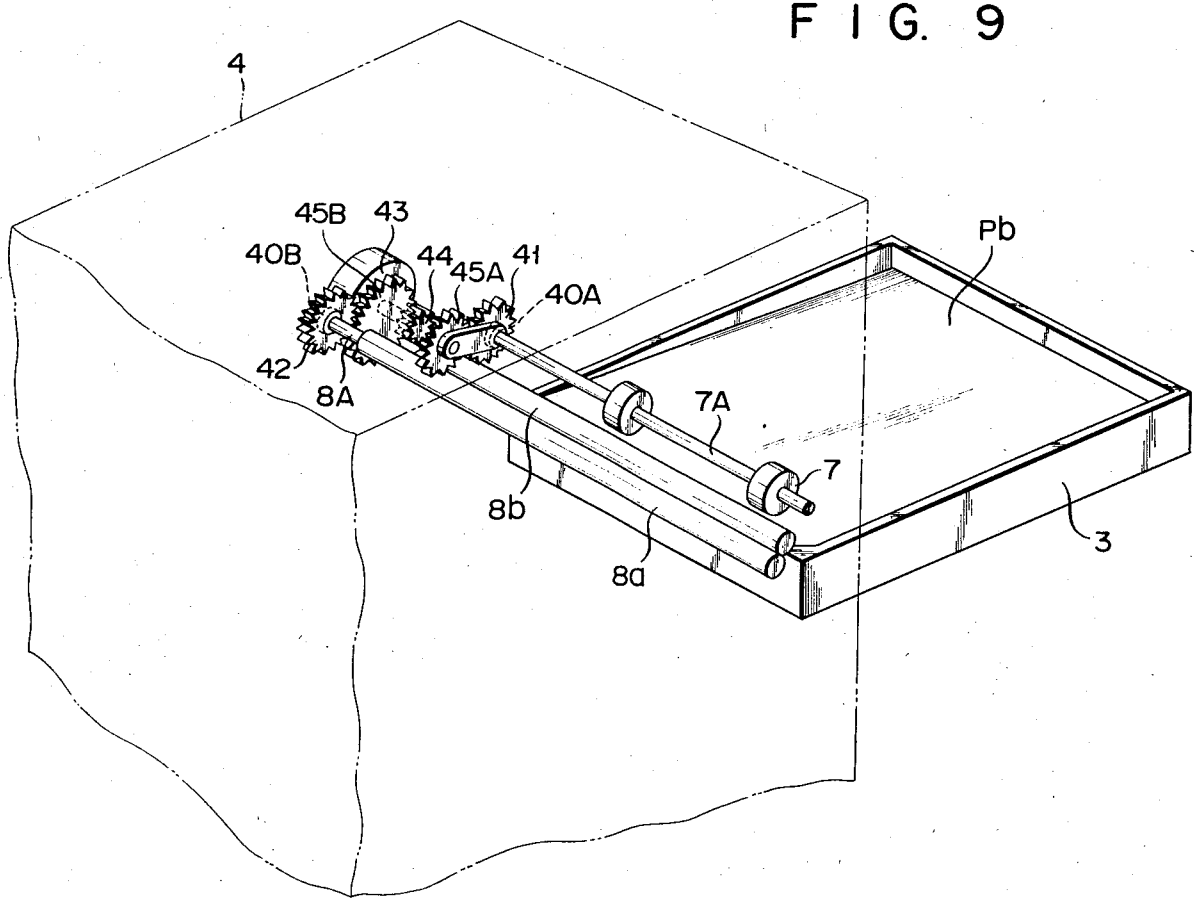
FIG. 9 is a schematic perspective view of a paper conveyor system according to a second embodiment of the invention.
Figure 10:
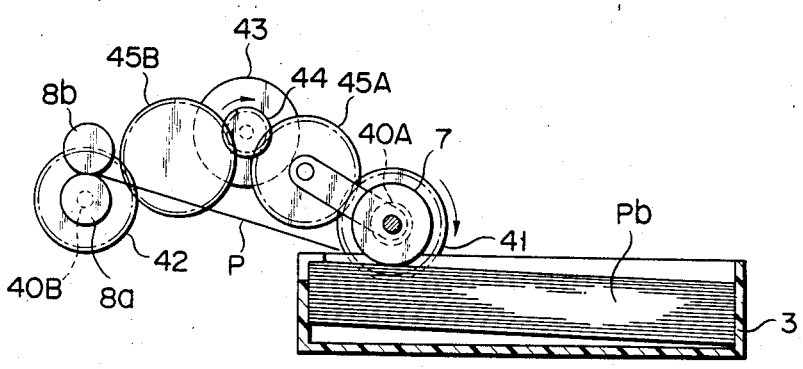
FIGS. 10 and 11 are sectional views for illustrating the operation of the second embodiment.
Figure 11:
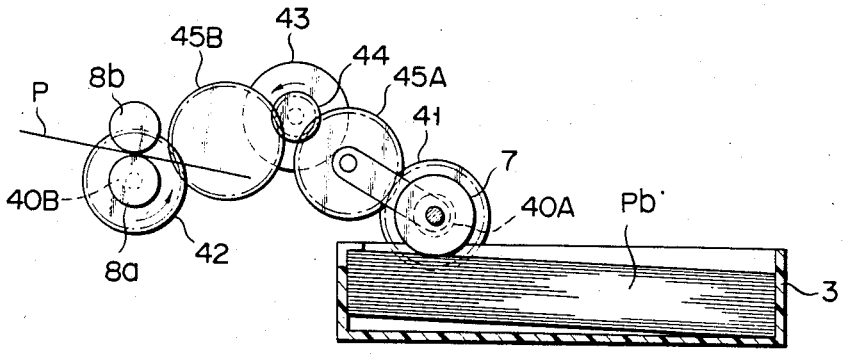

FIGS. 9 to 11 show a paper conveyor system according to a second embodiment of this invention. In the first embodiment, the first and second delivery rollers 6 and 7 are rotated by the one drive source 14, and the manual feed roller **5*a* and the resisting roller 8*a* are rotated by the other drive source 21. However, the arrangement of these rollers and drive sources is not limited to such combinations, and alternative combinations may be used. For example, the second delivery rollers 7 and the resisting roller 8*a*** may be selectively rotated by a common drive source.

In the second embodiment, as shown in FIG. 9, a driven gear 41 for delivery rollers 7 is attached to one end portion of the shaft 7A by means of a fifth one-way clutch 40A. The fifth one-way clutch 40A serves to transmit only the clockwise rotation of the driven gear 41 to the shaft 7A. A driven gear 42 for resisting rollers is attached by means of a sixth one-way clutch 40B to one end portion of the shaft 8A which rotates together with the lower resisting roller **8*a* in FIG. 9. The sixth one-way clutch 40B serves to transmit only the counterclockwise rotation of the driven gear 42 to the shaft 8A**.

A third drive source, e.g., a third reversible stepping motor 43, is disposed in the copying apparatus housing 4. A pinion gear 44 as a driving gear is mounted on the driving shaft of the third stepping motor 43. Idle gears 45A and 45B are arranged between the pinion gear 44 and the driven gears 41 and 42, respectively. The third stepping motor 43 is controlled by a drive control system similar to the one used in the first embodiment.

In the paper conveyor system according to the second embodiment thus constructed, if the third stepping motor 43 is rotated clockwise, as shown in FIG. 10, the second delivery rollers 7 are rotated clockwise by the fifth one-way clutch 40A. As a result, the paper Pb is fed toward the resisting rollers **8*a* and 8B. Hereupon, the driven gear 42 for resisting rollers is rotated clockwise through the idle gear 45B**. However, the resisting roller 8*a* is prevented from being rotated by the sixth one-way clutch 40B. If the third stepping motor 43 is rotated counterclockwise, as shown in FIG. 11, the lower resisting roller 8*a* is rotated counterclockwise by the sixth one-way clutch 40B. As a result, the paper Pb is fed between the resisting rollers 8*a* and 8*b*. Hereupon, the driven gear 41 for delivery rollers is rotated counterclockwise through the idle gear 45A. However, the second delivery rollers 7 are prevented from being rotated by the fifth one-way clutch 40A.

Thus, the second delivery rollers 7 or the resisting roller 8*a* may be rotated in an alternative manner by selecting the rotating direction of the third stepping motor 43. Accordingly, the paper conveyor system can be simplified in construction.

Figure 12:
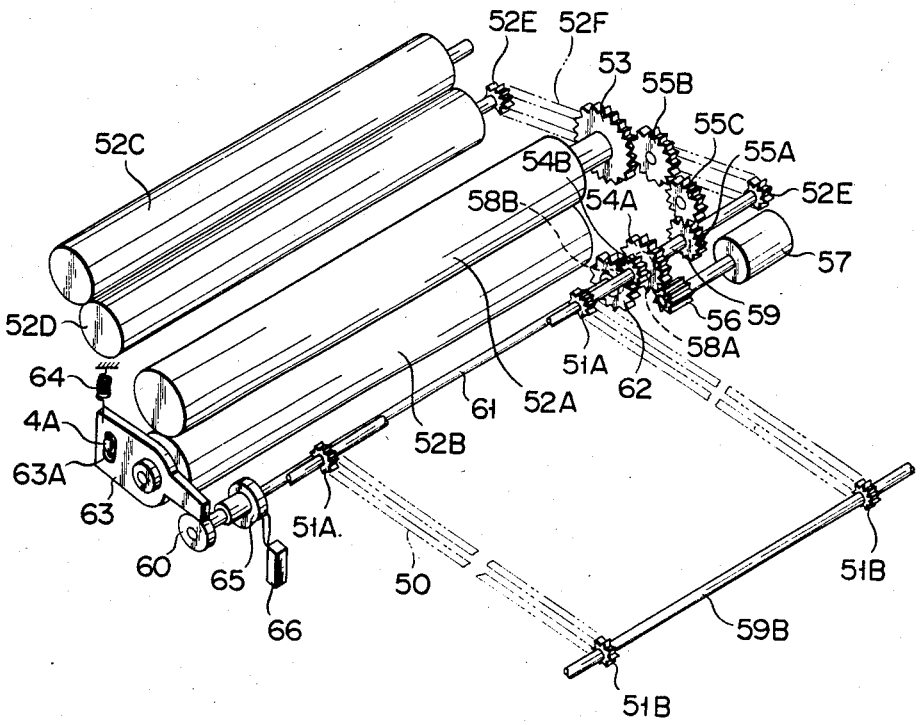
FIG. 12 is a perspective view of a paper conveyor system according to a third embodiment of the invention.
Figure 13:
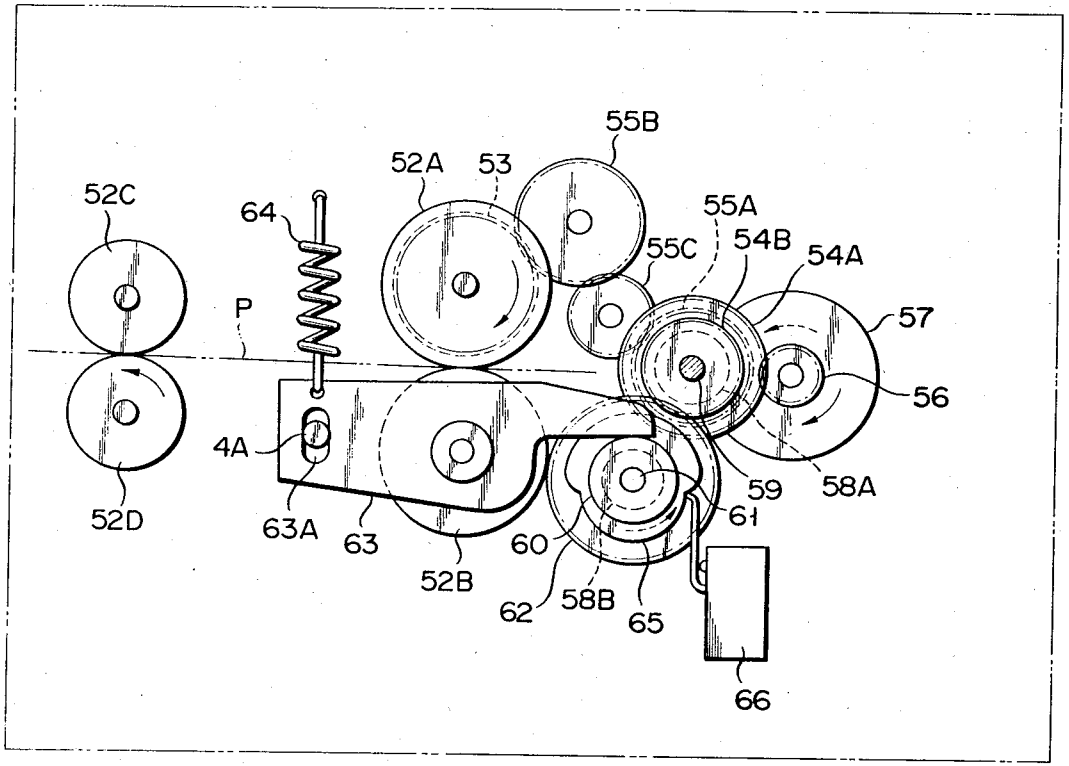
FIG. 13 is a side view schematically showing the third embodiment.

Referring now to FIGS. 12 and 13, there will be described a paper conveyor system according to a third embodiment of this invention. The paper conveyor system shown in FIGS. 12 and 13 is applied to three sections of a copying apparatus; a delivery section for deliverying developed paper, a fixing section for fixing the paper delivered thereto, and a paper discharge section for discharging the fixed paper. Inside the copying apparatus housing 4 shown in FIG. 4, conveyor belts 50 for carrying paper P developed by a developing device (not shown) are streched between belt pulleys 51A and 51B. The belt pulleys 51A rotate together with a driving shaft 59, while the other pulleys 51*b* rotate together with an idle shaft 59B. In order to pressurize for fixation the paper P fed by the conveyor belts 50, there are provided an upper roller 52A containing a heater (not shown) therein and a lower roller 52B abutting against the upper roller 52A at a desired pressure. Also provided are a pair of discharge rollers 52C and 52D for discharging the fixed paper P.

There will now be described a drive system for the belt pulleys 51A, the upper roller 52A, and the discharge roller 52D. A driven gear 53 is attached coaxially to one end of the shaft of the upper roller 52A. A driven gear 54A for the belt pulleys and a driven gear 54B for the cam shaft are formed coaxially and integrally. These two driven gears 54A and 54B are mounted on a driving shaft 59 by means of a seventh one-way clutch 58A. The seventh one-way clutch 58A serves to transmit only the counterclockwise rotation (FIG. 13) of the driven gear 54A to the driving shaft 59. The driving shaft 59 is fitted with a first idle gear 55A which rotates together therewith. Second and third idle gears 55B and 55C are arranged between the first idle gear 55A and the driven gear 53.

As shown in FIG. 12, timing belt gears 52E are attached individually to one end portion of the driving shaft 59 and one end portion of the shaft of the discharge roller 52D. A timing belt 52F is stretched between the two timing belt gears 52E. The driving force of a fourth stepping motor 57 is transmitted to the driven gear 54A for belt pulleys by means of a pinion gear 56 as a driving gear. If the fourth stepping motor 57 is rotated in the clockwise direction of FIG. 13, the belt pulleys 51A and the discharge roller 52D are rotated counterclockwise, while the upper roller 52A is rotated clockwise.

There will now be described a pressurization mechanism which presses the lower roller 52B against the upper roller 52A at a desired pressure to pressurize the paper P for fixation. Beside the lower roller 52B, a cam shaft 61 is pivotally supported by the copying apparatus housing 4. Eccentric cams 60 in the same phase and eccentric to each other are fixed individually to both end portions of the cam shaft 61 (only the one eccentric cam 60 attached to the left-hand end portion of the cam shaft 61 is shown in FIG. 12). An idle gear 62 to mesh with the driven gear 54B is mounted on an intermediate portion of the cam shaft 61 by means of an eighth one-way clutch 58B. The eighth one-way clutch 58B serves to transmit only the counterclockwise rotation (FIG. 13) of the idle gear 62 to the cam shaft 61.

Cam levers 63 are rotatably attached to both end portions, individually (only the one cam lever 63 attached to the left-hand end portion of the lower roller 52B is shown in FIG. 12). One end of each cam lever 63 is put on the peripheral surface of its corresponding eccentric cam 60, while the other end is urged against the upper roller 52A by an urging member 64 attached to the apparatus housing 4. A vertically elongated slot 63A is formed on the other end side of the cam lever 63 (under the urging member 64). A support pin 4A attached to the apparatus housing 4 is inserted in the slot 63A to define the horizontal movement of the lower roller 52B, as in FIG. 13.

A timing cam 65 is attached to an intermediate portion of the cam shaft 61. The timing cam 65 has large- and small-diameter portions which correspond to a rotation angle of 180 degrees each and are connected by means of two opposite step portions. A detecting end of a microswitch 66 is held against the peripheral surface of the timing cam 65. The microswitch 66 is a detecting means which is turned on and off when the step portions of the timing cam 65 is reached, thereby rotating the cam shaft 61 by approximately 180 degrees at a time in the counterclockwise direction of FIG. 13. As the cam shaft 61 is rotated by 180 degrees at a time by the microswitch 66, the lift of the cam lever 63 is maximized and minimized, respectively, at the positions where the maximum- and minimum-eccentricity portions of the eccentric cam 60 are in contact with the cam lever 63. As a result, the cam lever 63 moves up and down, so that the lower roller 52B also moves up and down along with the cam lever 63. Thus, the lower roller 52B alternately presses on and leaves the upper rollers 52A.

There will now be described the operation of the paper conveyor system according to the third embodiment.

First, in feeding and fixing paper developed by the developing device (not shown), the eccentric cam 60 and the timing cam 65 mounted on the cam shaft 61 are brought into the state shown in FIG. 13. If the fourth stepping motor 57 is rotated in the clockwise direction of FIG. 13, the driving shaft 59 is rotated counterclockwise by the agency of the seventh one-way clutch 58A. As a result, the belt pulleys 51A, the discharge roller 52D, and the upper roller 52A are rotated so that the paper P is fixed as it is transferred.

When not in copying operation, the fourth stepping motor 57 is rotated in the counterclockwise direction of FIG. 13 in order to disengage the lower roller 52B from the upper roller 52A. Accordingly, the driving shaft 59 is prevented by the seventh one-way clutch 58A from being rotated, and only the cam shaft 61 is rotated counterclockwise by the agency of the eighth one-way clutch 58B. As the cam shaft 61 rotates gradually, the eccentricity at the contact portion between the eccentric cam 60 and the cam lever 63 decreases gradually. As the eccentricity decreases, the cam lever 63 is lowered, and thus the lower roller 52B is disengaged from the upper roller 52A. When the timing cam 65 is rotated through 180 degrees, the fourth stepping motor 57 is stopped by the microswitch 66. At this time, the eccentricity is maximized. In starting copying operation thereafter, the fourth stepping motor 57 is rotated in the counterclockwise direction of FIG. 13 to rotate the cam shaft 61 through 180 degrees. Thereupon, the eccentricity increases gradually. As the cam lever 63 then rises, the lower roller 52B comes to press on the upper roller 52A.

Thus, the feed of paper or the pressurization by the lower roller 52B (or disengagement thereof from the upper roller 52A) may be achieved in an alternative manner by selecting the rotating direction of the fourth stepping motor 57. Accordingly, the copying apparatus can be simplified in construction.

In the paper conveyor system of this invention, as is evident from the above description, a single drive source can perform two functions by changing its rotating direction. Thus, the system can be simple in construction and conducive to miniaturization.

What is claimed is:

1. A paper conveyor system comprising:

first feeding means disposed rotatably and rotating in a direction for feeding paper along a first path of travel;

second feeding means disposed rotatably and rotating in a direction for feeding paper along a second path of travel;

first clutch means attached to the first feeding means, for transmitting rotation in said first paper feeding direction to the first feeding means, and for preventing rotation in the other direction opposite to said first paper feeding direction from being transmitted to the first feeding means;

second clutch means attached to the second feeding means, for transmitting rotation in said second paper feeding direction to the second feeding means, and for preventing rotation in the other direction opposite to said second paper feeding direction from being transmitted to the second feeding means;

a first reversible motor capable of selectively rotating in either direction;

first transmission means arranged between the first reversible motor and the first clutch means to transmit the rotation of the first reversible motor to the first clutch means so that the first clutch means rotates in the same direction as the rotating direction of the first reversible motor; and second transmission means arranged between the first reversible motor and the second clutch means to transmit the rotation of the first reversible motor to the second clutch means so that the second clutch means rotates in the opposite direction to the rotating direction of the first reversible motor;

third feeding means disposed rotatably and rotating in a direction for feeding paper along a third path of travel;

fourth feeding means disposed rotatably on the downstream side of the third path of travel and rotating in a direction for feeding along a fourth path of travel paper received from said first, second and third feeding means;

third clutch means attached to the third feeding means, for transmitting rotation in said third paper feeding direction to the third feeding means, and for preventing rotation in the other direction opposite to said third paper feeding direction from being transmitted to the third feeding means;

fourth clutch means attached to the fourth feeding means, for transmitting rotation in said paper feeding direction to the fourth feeding means, and for preventing rotation in the other direction opposite to said paper feeding direction from being transmitted to the fourth feeding means;

a second reversible motor capable of selectively rotating in either direction;

third transmission means arranged between the second reversible motor and the third clutch means to transmit the rotation of the second reversible motor to the third clutch means so that the third clutch means rotates in the same direction as the rotating direction of the second reversible motor; and fourth transmission means arranged between the second reversible motor and the fourth clutch means to transmit the rotation of the second reversible motor to the fourth clutch means so that the fourth clutch means rotates in the opposite direction to the rotating direction of the second reversible motor.

2. The paper conveyor system according to claim 15, wherein said reversible motor is formed of a stepping motor.

3. The paper conveyor system according to claim 1, which further comprises:

first container means containing a stack of paper fed by said first feeding means; and second container means containing a stack of paper fed by said second feeding means.

4. The paper conveyor system according to claim 3, wherein said first feeding means comprises a first delivery roller to pick up the paper contained in the first container means, and said second feeding means comprises a second delivery roller to pick up the paper contained in the second container means.

5. The paper conveyor system according to claim 4, said third feeding means comprising a first pinch roller disposed rotatably and in rolling contact with a feeding roller; and said fourth feeding means comprising a second pinch roller disposed rotatably and in rolling contact with a feeding roller, and wherein said first pinch roller and said feeding roller hold therebetween and feed paper supplied manually.

6. The paper conveyor system according to claim 5, said second pinch roller and said feeding roller being located on the downstream side of the first and second paths of travel, and said first to third paths of travel terminating at the rolling contact portion between the feeding roller and the second pinch roller.

7. The paper conveyor system according to claim 6, wherein said second pinch roller of said fourth feeding means serves as a resisting roller.

8. The paper conveyor system according to claim 1, which further comprises:

first container means containing a stack of paper fed by said first feeding means; and second container means containing a stack of paper fed by said third feeding means.

9. The paper conveyor system according to claim 8, said first feeding means comprising a first delivery roller to pick up the paper contained in the first container means, and said third feeding means comprising a second delivery roller to pick up the paper contained in the second container means.

10. The paper conveyor system according to claim 9, said second feeding means comprising a first pinch roller disposed rotatably and in rolling contact with a feeding roller; and said fourth feeding means comprising a second pinch roller disposed rotatably and in rolling contact with a feeding roller, and wherein said first pinch roller and said feeding roller hold therebetween and feed paper supplied manually.

11. The paper conveyor system according to claim 10, said second pinch roller and said feeding roller being located on the downstream side of the first and second paths of travel, and said first to third paths of travel terminating at the rolling contact portion between the second pinch roller and the feeding roller.

12. The paper conveyor system according to claim 11, wherein said second pinch roller of said fourth feeding means serves as a resisting roller.

* * * * *